US006801322B2

(12) United States Patent
Mautz

(10) Patent No.: US 6,801,322 B2
(45) Date of Patent: Oct. 5, 2004

(54) METHOD AND APPARATUS FOR IN SITU MEASURING A REQUIRED FEATURE OF A LAYER DURING A POLISHING PROCESS

(75) Inventor: Karl Mautz, Round Rock, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 222 days.

(21) Appl. No.: 10/021,756

(22) Filed: Dec. 13, 2001

(65) Prior Publication Data

US 2003/0112451 A1 Jun. 19, 2003

(51) Int. Cl.[7] ..... G01B 9/02
(52) U.S. Cl. ..... 356/504
(58) Field of Search ..... 356/504, 502, 356/432, 630

(56) References Cited

U.S. PATENT DOCUMENTS 5,748,318 A * 5/1998 Maris et al. ..... 356/630
5,773,316 A 6/1998 Kurosaki et al.
6,071,177 A * 6/2000 Lin et al. ..... 451/6
6,277,656 B1 8/2001 Goruganthu et al.

FOREIGN PATENT DOCUMENTS

WO WO 99/23449 5/1999

OTHER PUBLICATIONS

PCT/US02/38583 PCT Search Report mailed Mar. 19, 2003.

* cited by examiner

*Primary Examiner*—Samuel A. Turner
(74) *Attorney, Agent, or Firm*—Kim-Marie Vo; Patricia S. Goddard

(57) ABSTRACT

The invention relates to a method for measuring a required feature of a thin layer (4) used in a polishing process that is carried out by a polish head by producing a localized temperature rise on the surface of the layer (4) by focusing a short pump laser pulse (11) on the surface of the layer, as to generate a sound wave (13) that propagates into the layer; repeated measuring the surface reflection properties of the layer, by passing a probe laser pulse (21) and focusing it on the surface of the layer and by monitoring the portion of the probe laser pulse that is reflected (22) by the surface, as to detect a change in surface reflection properties caused by a boundary echo (32) that is a reflected part of the sound wave (13); measuring the elapsed time between the generation of the sound wave and the change in surface reflection properties; and calculating the required layer feature.
Furthermore the invention relates to a measuring apparatus, which is able to perform the above-mentioned method.

27 Claims, 2 Drawing Sheets

METHOD AND APPARATUS FOR IN SITU MEASURING A REQUIRED FEATURE OF A LAYER DURING A POLISHING PROCESS

FIELD OF THE INVENTION

The present invention generally relates to a method and an apparatus for measuring a required feature of a layer of known material of an object to be polished during a polishing process. More particularly the present invention relates to an apparatus and a method of in-situ measurement of layer thickness for chemical mechanical polishing (CMP).

BACKGROUND OF THE INVENTION

Integrated circuits are typically formed on substrates, particularly silicon wafers. The integrated circuits are formed by depositing different layers of conducting, semiconducting or insulating nature. After deposition of each layer, features of the electrical circuits are incorporated, e.g. by etching. During the sequential procedure, the upper surface of the substrate becomes more and more non-planar. Thus, the surface of the substrate has to be planarized in order to provide a substantially planar surface.

For example, such planarization can be achieved by chemical mechanical polishing (CMP). In general, during a CMP process a substrate is mounted to a carrier or polishing head. The exposed surface of the substrate is moved against a rotating polishing pad on a polishing platen. A polishing slurry is distributed over the polishing pad. The slurry includes an abrasive component and at least one chemically reactive agent; thus, an abrasive chemical solution is provided at the interface between the pad and the wafer in order to optimize the polishing.

In general, it is desirable to control CMP processes, in order to find an endpoint for polishing or to determine the thickness of a layer.

According to a prior art control process pre and/or post measurement of wafers with either manual or automatic feedback control is performed. Systems are available by which it is possible to measure wet wafers immediately before and after polishing. Due to the monitoring of the condition of the surface before and after polishing it is possible to change the polishing parameters, and therefore, to optimize the polishing during a series production. However, such pre and/or post measurement method bears the disadvantage that the first or the first few wafers have to be polished without optimized parameters—they are polished "blind". Further, during a series production the appearance of the wafers might vary; the pre and/or post measurement method is not capable to consider such variations of the wafers.

In order to find the correct endpoint for polishing several endpointing methods are available. Current methods include measuring temperature, friction, vibration, sonic level, and frequency. Further, various optical measurements are available, e.g. reflection properties measurement methods. Unfortunately, these processes do not work for all substances, in particular when an oxide is polished. However, a major portion of CMP processing is polishing metal films. An optical metrology film measurement technique cannot be used for measurement of opaque films.

Acoustic wave techniques have been applied in the prior art to measure layer thicknesses in a measurement environment where no mechanical treatment is done in parallel, i.e. no in-situ measurement by acoustic wave techniques bas been demonstrated for CMP.

Accordingly, there is a need for a measuring method that can be employed to measure the thickness of opaque films or layers without mechanical contacting or damaging of the layer. A further object of the present invention is to provide a measuring apparatus for thickness measurements of a thin layer, especially of opaque layers. The method and the apparatus of the present invention should be applicable to CMP endpointing.

DETAILED DESCRIPTION OF A PREFERRED EMBODIMENTS

Figure 1:
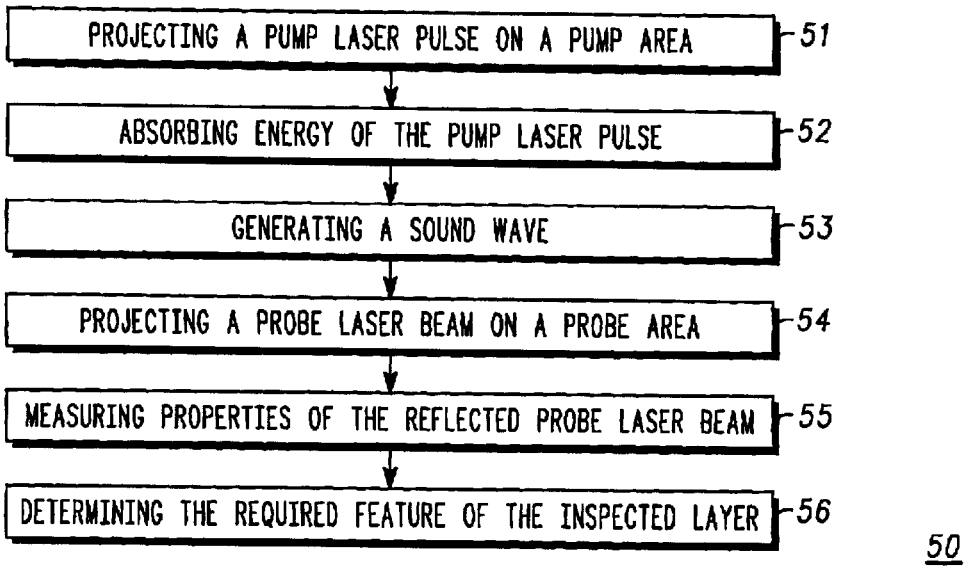
FIG. 1 is a flow diagram of a method for measuring the thickness of a thin layer according to the present invention.
Figure 2A:
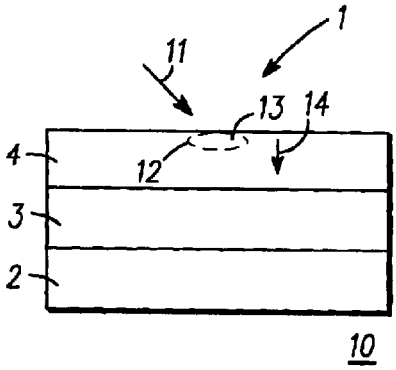
FIG. 2 illustrates in a schematic diagram a method for measuring the thickness of a thin layer according to the present invention.
Figure 2B:
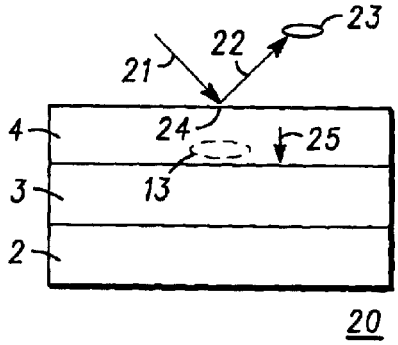
Figure 2C:
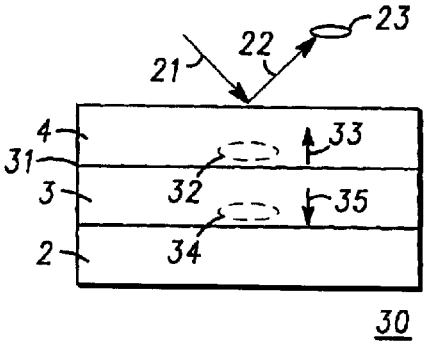
Figure 2D:
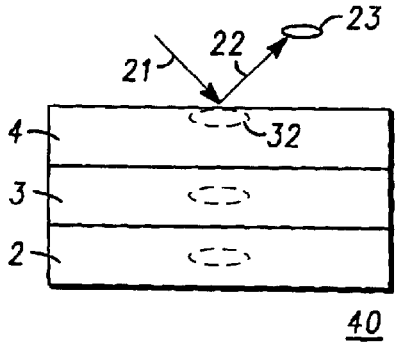

According to the present invention, a method for in-situ measuring a required feature of an inspected layer within a structure during a polishing process that is carried out by a polish apparatus, the structure having a surface, the method consisting of repeated feature measurements each comprising the steps of: projecting a pump laser pulse on a pump area of the surface; absorbing energy of the pump laser pulse on the surface of the inspected layer; generating a sound wave that propagates into the structure; projecting a probe laser beam on a probe area of the surface, the probe laser beam being reflected on the probe area forming a reflected probe laser beam; measuring properties of the reflected probe laser beam as a function of time; and determining the required feature of the inspected layer from the measured properties of the reflected probe laser beam as a function of time.

A measuring apparatus according to the present invention comprises a first laser light source for generating a pump laser pulse; a first light guiding means for guiding the pump laser pulse to a pump area of the surface for generating a sound wave that propagates into the structure; a second laser light source generating a probe laser beam; a second light guiding means guiding the probe laser beam to a probe area of the surface; a detector detecting properties of the probe laser beam after being reflected from the surface of the layer, and providing a detector signal in accordance with properties of the reflected probe laser beam; a time measurement means for measuring the time between two events; and a calculating means for calculating the required feature of the layer using the detector signal and the measured elapsed time between two events.

The most important feature measured is the thickness of the layer. This method proposes an alternate metrology technique to facilitate CMP endpointing based on acoustical wave metrology. Acoustical wave metrology allows measurement of film thickness in real time on opaque films such as metals, and on translucent films such as oxides and dielectrics.

The primary advantage of this method is to measure opaque film layers deposited on a wafer, that cannot be measured in a conventional optical way. Furthermore this technique can be used to monitor the polish rate of a surface film in real time during a CMP process. As a result of the measurement the completion time can be estimated.

It is a non-contact, fast and non-destructive measurement method. The thickness of the layer that is to be measured can range from 20 Å to 5 $\mu$m. The method has an accuracy of 1–4 Å or less for most film materials. Surface roughness effects (such as particles or slurry films) can be subtracted out due to the timing of the resultant signal. The method is additionally used for determining all thicknesses in a stack of multiple film layers, film adhesion of layers in a stack, buried surface roughness, inter-diffusion of species, inter-layer reactions, and inter-layer contamination, density variations, phase changes (as in silicon films), and missing film layers within a stack.

According to the present invention, acoustic wave techniques are applied to measure layer thicknesses in-situ during mechanical surface treatment such as polishing, especially CMP. One major difficulty for in-situ monitoring a polish process is that the free surface of the layer being polished is in contact to a polish cloth and thus not freely available for inspection. The present invention overcomes this difficulty by two approaches, namely measurement from the frontside of the object being polished, especially a wafer, and measurement from it's backside.

In the following the invention will be explained with respect to wafer CMP but those in the art will understand that this is not limiting with respect to other objects or other surface treatments.

In-situ measurement of the layer being polished from the backside of the wafer is performed with an apparatus having the laser source or sources or at least a window for a laser beam in a polish head. A soundwave is generated on the wafer backside and travels through the wafer. The soundwave is partly reflected at every layer boundary between layers of different wafer materials, thereby generating boundary echos which also form sound waves. The echos travel to the wafer backside and are detected by a probe laser beam upon the wafer backside. A detector receiving at least a part of the reflected probe laser beam provides a signal that contains information of all wafer layers including the wafer frontside layer being polished. An evaluation unit calculates the required feature of the wafer frontside layer being polished using the detector signal and the measured elapsed time between two echos originating from both sides of the wafer frontside layer. This approach has the advantage of a probe area without slurry. It uses two echos most remote from the wafer backside.

In-situ measurement of the layer being polished from the frontside of the wafer is performed with an apparatus having the laser source or sources in the polish table and having a window for a laser beam in a polish pad and polish cloth. A soundwave is generated on the wafer frontside and travels through the wafer. The soundwave is partly reflected at every layer boundary between layers of different wafer materials, thereby generating boundary echos which also form sound waves. The echos travel to the wafer frontside and the first echo is detected by a probe laser beam upon the wafer frontside. A detector receiving at least a part of the reflected probe laser beam provides a signal that contains information of at least the frontside layer being polished. An evaluation unit calculates the required feature of the wafer frontside layer using the detector signal and the measured elapsed time between a sound generation and a first echo originating from the boundary of the wafer frontside layer. This approach has the advantage of using the strongest echo. A slurry is on the wafer frontside.

According to another embodiment of the present invention subsequent boundary echoes are measured, which originate from the boundaries or interfaces between deeper layers. Thus layers of multi-layer stacks can be measured individually and simultaneously. Software-analysis of the received signals converts the time between sound generation and the detection of boundary echoes into an accurate film thickness value. During calculation of the feature, i.e. the thickness of the layer, it is appropriate to use specific or customizable algorithms to process the measured signals. Thus correlation can be made to a database to determine expected patterns or noise effects. If a pump laser pulse is at least partly absorbed, i.e. the sound wave is generated, on a surface of a layer to be inspected, then it is sufficient to observe the echo of the boundary to the adjacent layer and the time between pump pulse and echo. Otherwise the time between two echos has to be determined.

By using laser pulses for generation of the sound wave (or acoustic wave) and for detection of the change of the surface reflection properties the complexity needed for this practical application is less critical, and as such reduces the component size, cost and the difficulty to implement the method within an adapted CMP tool apparatus. It is also possible to optimize the power and the duration of the pump laser pulse. Due to only the layer being polished requiring measurement and with film measurement accuracy at +/−10 Å the complexity of the components can be reduced. There is also no risk to damaging the thin layer because the surface temperature will be increased only 5 or 10 K. Preferably the duration of the pump laser pulse is from $10^{-12}$ to $10^{-14}$ seconds.

As to monitor the portion of the probe laser beam that is reflected by the surface in a certain direction and reflection angle respectively, the intensity of the reflected part of laser light can be measured. This can be implemented with a continuous probe laser beam or a pulsed probe laser beam. Further, the kind of detection of the reflected probe laser beam can be implemented in various ways. The energy distribution, i.e. beam diameter and/or the position of the beam center can be altered as the reflection takes place at the probe area depending on the surface condition which is altered by the sound wave.

Advantageously the reflected probe laser beam is monitored in a distance from the probe area where the alteration by the sound wave is amplified such that energy distribution, beam diameter and/or position can easily be measured. A position sensitive element or a detector array can be used as detector. Advantageously, a light sensing element is used as detector positioned e.g. behind a blind at a defined place. Such a place can be chosen such that the light sensing element receives an extreme light intensity if the sound wave reaches the surface.

In embodiments using a continuous probe laser beam advantageously extrema in a sensor signal are identified and the time between events, i.e. pump pulse-extreme or extreme—extreme will be a measure for the layer thickness.

In embodiments using pulsed laser beams the timing of the probe laser pulses with respect to the pump laser pulse is important as each probe laser pulse probes the appearance of a sound wave on the surface. Thus the knowledge of the expected time when the sound wave appears on the surface is necessary. The system implementation allows to design and calibrate the system such that the layer thickness, probe pulse time and detector signal are coordinated such that the required layer thickness can be determined from the pulse timing and the signal. Preferably, generation and probe pulses are repeated periodically with correct phase such that the probe pulse rate comprises the probe pulse timing information. This allows the required feature of the layer to be determined from a laser pulse rate and suits a system to be calibrated for polish endpoint detection.

Preferably, the pulse laser beam is focused on the surface. This provides a soundwave starting from a small area.

In further embodiments the probe area and the pump area overlap or are even identical. This allows a short distance for the sound wave to travel. It allows further to use one single pulsed laser beam to be pump and probe beam. Then, laser pulses are repeated with a pulse rate such that they feed into a standing sound wave and a reflected part of the pulses is analysed. Such a system can be operating in a resonant mode where the pulse rate is adjusted to keep the system in resonance during the layer thickness reduction caused by the polishing. Such a system can also be operating in a non-resonant mode where the pulse rate is constant and the system identifies polish endpoint by detecting resonance.

In other embodiments the probe area and the pump area do not overlap.

Furthermore, in an embodiment for in-situ measurement of the layer being polished from the wafer frontside according to the present invention a measuring apparatus associated to a polishing head having a polishing platen for measurement of a required feature of a thin layer is comprised of: a first laser light source providing a short pump laser pulse to the surface of the thin layer, as to increase the localized temperature of the surface, as a result of which a sound wave propagates into the layer; a second laser light source providing a probe laser pulse to the surface of the thin layer; a detector receiving at least a part of the reflected probe laser pulse, that is reflected from the probe area, and providing a detector signal accordingly; time measurement means that measure the elapsed time between providing of the pump laser pulse and a change of the reflecting signal caused by a boundary echo of the sound wave reaching the surface of the layer; calculating means that calculate the required feature of the layer using the measured elapsed time and the specific sound speed of the material of the layer; whereby the pump laser pulse, the probe laser pulse and the reflected part are passed through a window, which is transparent to the laser pulses and positioned in the polishing platen.

Such an apparatus can be employed as a stand-alone system or in combination with other existing CMP endpointing techniques. The inventive apparatus can be used for measurements on either translucent or opaque films or layers.

Preferably the detector is mounted in the area of the CMP polish head window, as to receive the reflected part of the probe laser while the polishing process is in progress.

In a preferred embodiment the thickness of the layer is calculated by the calculating means. Often it is enough to measure only top film thickness with moderate accuracy, such as +/−10 Å.

In another preferred embodiment of the measuring apparatus the first and second laser light sources are supplied from a shared laser apparatus. It is advantageous to make use of a beam splitter and an optical delay-stage as to create the probe laser pulse. The optical delay-stage is well suited to provide a probe pulse delay in the range of times the sound wave needs to travel two times through one layer.

An another embodiment the apparatus according to the invention has a variable delay-stage. By varying the laser light path length the time between the pump pulse and the detection pulse will be changed.

In a more preferred embodiment the detector receiving a part of the probe laser pulse is a position resolving detector or is formed as a detector array. In this way also more than one position on the surface of the layer could be measured. An array of detectors can be located offset to the laser light source in the platen direction of rotation.

The features of the invention are set forth with particularity in the appended claims. The invention itself, together with its further objects and advantages thereof, may be best understood by reference to the following detailed description when taken in conjunction with the accompanying drawing.

FIG. 1 illustrates a method for measuring the thickness of a thin layer in flow diagram 50 and FIG. 2 illustrates the method applied to a wafer. The method of in-situ measuring a required feature of an inspected layer 4 within a structure, here wafer 1, during a polishing process that is carried out by a polish apparatus, the structure having a surface, the method comprises repeated layer feature measurements each comprising the steps of

- projecting (51) a pump laser pulse 11 on a pump area 12 of the surface;
- absorbing (52) energy of the pump laser pulse 11 on the surface of the inspected layer 4;
- generating (53) a sound wave 13 that propagates into the structure;
- projecting (54) a probe laser beam 21 on a probe area 24 of the surface, the probe laser beam 21 being reflected on the probe area 24 forming a reflected probe laser beam 22;
- measuring (55) properties of the reflected probe laser beam 22 as a function of time;
- determining (56) the required feature of the inspected layer from the measured properties of the reflected probe laser beam 22 as a function of time.

The wafer 1 has a lower film 2 (or layer), an intermediate film 3 and an upper film layer 4. In the first state referenced by reference sign 10 the pump laser pulse 11 is directed to the surface of the upper film layer 4. This pump laser pulse 11 increases the temperature in the probe area 12 (area of local temperature rise) on the surface of the upper film layer 4. The pump laser pulse is approximately $10^{-13}$ seconds long and produces a localized temperature rise of 5–10 K. The laser pulse 11 focused onto the surface causes a rapid thermal expansion and generates the sound wave 13, which is illustrated by an ellipse. The sound wave will move in the direction of arrow 14.

In the second state 20 the sound wave 13 propagates away from the surface at the speed of sound in the material of upper film layer 4. Furthermore the probe laser pulse 21 is directed onto the surface of the upper film layer 4. The probe laser pulse 21 has a lower power than the pump laser pulse but it will be focused onto the surface repeatedly. The probe laser pulse 21 is reflected by the surface in a specific reflection angle. The reflected partial beam 22 reaches a detector 23. The detector 23 receives the reflected beam 22 and generates a detector signal. The detector signal is dependent on the reflection properties of the surface of the upper film layer 4, which depend on the sound wave if present. The sound wave will move in the direction of arrow 25.

State 30 shows the situation after the sound wave 13 has reached an interface or boundary area 31 between the upper film layer 4 and the intermediate film 3. A part of the sound wave 13 will be reflected at this boundary area 31 and a boundary echo 32 propagates back to the surface of the upper film layer 4, indicated by arrow 33. A second part 34 of the sound wave 13 penetrates the boundary area 31 and propagates through the intermediate film 3, indicated by arrow 35.

If in the fourth state 40 the boundary echo 32 reaches the surface of the upper film layer 4 it will change the reflection properties of the surface. The detector 23 monitors the reflected beam 22 with every probe laser pulse. When the boundary echo 32 changes the reflection properties of the surface of the upper film layer 4 the detector 23 will generate a changed detector signal. Conventional means for time measuring are used to measure the elapsed time between the generation and the change of reflection properties, preferably a computer. The system's software converts the time between sound generation and echo detection into an accurate thickness value of film layer 4. The features of the material of the film which is to be measured are stored. Especially the sound speed of the material is used to calculate the thickness value taking account of measured time, density and expected thickness.

Further boundary echoes will be produced at any boundary area or interface between different layers or films. Thus it is possible to measure the different periods of time for different boundary echoes. In the same way as above-mentioned the thickness of the intermediate film 3 can be calculated taking account of the elapsed time between sound generation and detection of the second boundary echo. Consequently it is possible to measure lower or deeper layers also.

Preferably the polishing is stopped before a measurement and the the polishing is resumed after the measurement while the structure stays in the polishing apparatus. This is still an in-situ method since the object to be polished has not to be removed from the polish head nor has the polish head to be lifted.

Figure 3:
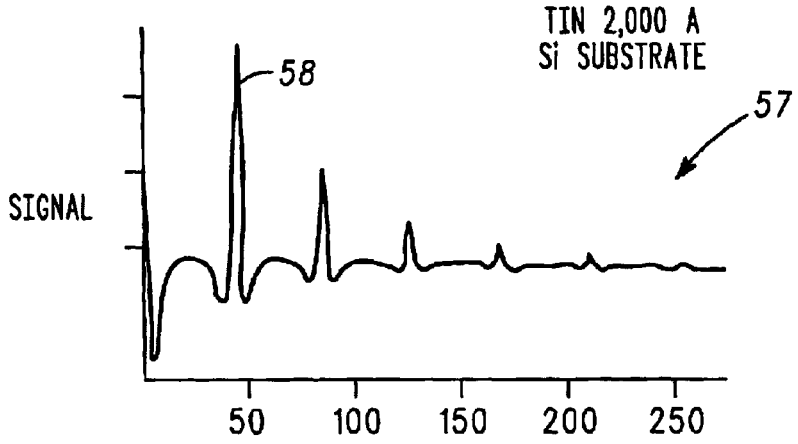
FIG. 3 is a diagram of a measured signal showing change in surface reflection properties as a result of boundary echoes.

FIG. 3 shows a plot 57 of the detector signal in an embodiment comprising a continuous probe laser over the time. The tested material is a silicon substrate with a thickness of 2,000 Å. The first peak 58 of the curve shows the moment at which the first boundary echo reaches the surface of the substrate. The following peaks occur on the basis of multiple reflections of the sound wave, which propagates through the substrate. However, in cases like in the example shown with FIGS. 1, 2, the system only needs to distinguish the first boundary echo (that corresponds to the first film interface of the top layer). This will adequately determine the thickness of the layer, e.g. layer 4 in FIG. 2. The plot 57 displayed in FIG. 3 shows the results of a measurement in a single layer film.

Figure 4:
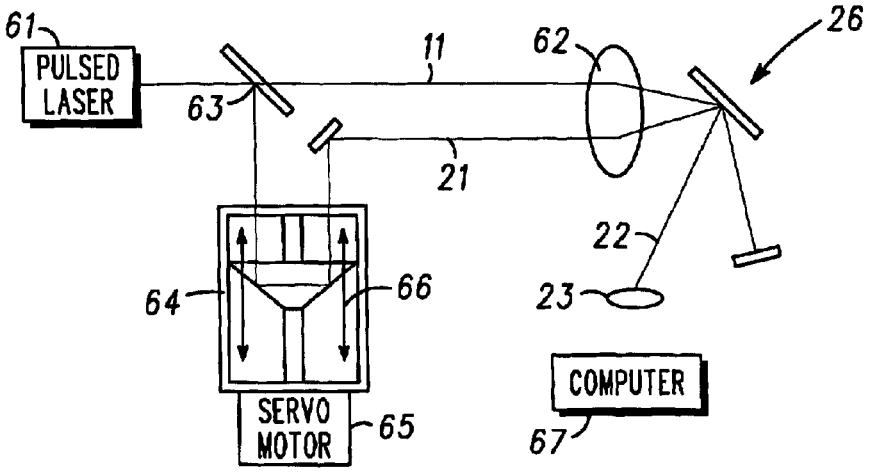
FIG. 4 illustrates in a schematic diagram a measuring apparatus according to the present invention.

FIG. 4 illustrates the structure of the measuring apparatus. The apparatus has a pulsed laser 61, preferably a femtosecond pulsed laser. The laser 61 generates the pump laser pulse 11, which is directed onto the wafer 1. An optical lens 62 is used to focus the pump laser pulse 11 onto the surface of the wafer 1. A beam splitter 63 splits the laser beam as to create the probe laser pulse 21. In the depicted embodiment the probe laser pulse 21 passes through a delay-stage 64, which inserts a certain delay on the basis of the path length. A servo-motor 65 enables the variation of the path length by moving a triple-prism 66. The delay-stage 64 varies the time between the pump pulse and the detection pulses, allowing the reflection properties changes occurring over a period of time to be detected. The same optical lens 62 is used to focus the probe laser pulse 21 onto the surface 26 of the wafer 1. As above-mentioned the detector 23 monitors the reflected beam 22. Computer 67 performs a time measurement and calculates the layer thickness. The change in reflection properties over the time delay can then be observed. The illustrated apparatus can be mounted as a separate sensor module on a system used for CMP processes. The measurement apparatus can be supported through either the tool microprocessor or a dedicated system. The complexity and functionality of the measuring apparatus and the associated control software can be reduced by the dedication of the system to measure only top film thickness with moderate accuracy (such as +/−10 A). However, in general the described invention can measure the thickness of single or multi-layered films.

As above-mentioned the laser pulses are passed through a window in a polishing platen of a polishing head (not shown). Thus the above-mentioned CMP endpoint measurement system according to the state of the art could be improved by the present invention.

While the invention has been described in terms of particular structures, devices and methods, those of skill in the art will understand based on the description herein that it is not limited merely to such examples and that the full scope of the invention is properly determined by the claims that follow.

What is claimed is:

1. A method of in-situ measuring a required feature of an inspected layer within a structure during a polishing process that is carried out by a polish apparatus, the method comprising:

providing a structure having a substrate and an inspected layer, wherein the substrate has a front side and a backside and the inspected layer is over the front side;

projecting a pump laser pulse on a pump area of the backside of the substrate;

absorbing energy of the pump layer pulse on the backside of the substrate;

generating a sound wave that propagates into the structure;

projecting a probe laser beam on a probe area of the backside of the substrate, the probe laser beam being reflected on the probe area forming a reflected probe laser beam;

measuring properties of the reflected probe laser beam as a function of time; and determining the required feature of the inspected layer from the measured properties of the reflected probe laser beam as a function of time.

2. The method of claim 1, wherein measuring the properties of the reflected probe laser beam comprises measuring the position of the reflected probe laser beam.

3. The method of claim 1, wherein the structure comprises several structure layers having layer boundaries between them, the sound wave being partly reflected at each layer boundary forming boundary echos and position of the reflected probe laser beam changing when a boundary echo reaches the probe area.

4. The method of claim 1, wherein the required feature of the layer is determined from a time difference between changes in measured positions of the reflected probe laser beam due to two subsequent boundary echos of the inspected layer.

5. The method of claim 1, wherein the required feature of the layer is determined from a laser pulse rate.

6. The method of claim 1, wherein the probe laser is pulsed.

7. The method of claim 1, wherein the probe laser beam is generated from pulse laser beam via beam splitter.

8. The method of claim 1, wherein the pulse laser beam is focused on the surface.

9. The method of claim 1, wherein the surface is a back surface of the structure opposite to a polish surface of the structure being polished.

10. The method of claim 1, wherein the surface is a polish surface of the structure being polished.

11. The method of claim 1, wherein the inspected layer is adjacent to the polish surface of the structure.

12. The method of claim 1, wherein the probe area and the pump area overlap.

13. The method of claim 1, wherein the probe area and the pump area do not overlap.

14. The method according to claim 1, wherein the inspected layer is the layer being polished and in the step of calculating the thickness of the inspected layer is calculated.

15. The method of claim 1, wherein the structure comprises an additional outer translucent layer of a material translucent to the laser beams.

16. The method of claim 1, wherein the method is used for real time measurements during carrying out a chemical mechanical planarization (CMP) process.

17. The method of claim 1, wherein the method is used to determine the endpoint of a CMP process.

18. A measuring apparatus for in-situ measurement of a required feature of an inspected layer within a structure during a polishing process, the structure having a surface, the apparatus comprising:

a first laser light source for generating a pump laser pulse;

a first light guiding means for guiding the pump laser pulse to a pump area of the surface through a window in a polish platen, wherein the first light guiding means generates a sound wave that propagates into the structure;

a second laser light source generating a probe laser beam;

a second light guiding means guiding the probe laser beam to a probe area of the surface through the window in the polish platen;

a detector for detecting properties of the probe laser beam after being reflected from the surface of the layer, and providing a detector signal in accordance with properties of the reflected probe laser beam;

a time measurement means for measuring the time between two events; and a calculating means for calculating the required feature of the layer using the detector signal and the measured elapsed time between two events.

19. The method of claim 18, wherein the properties of the reflected probe laser beam comprises measuring the position of the reflected probe laser beam.

20. The measuring apparatus of claim 18, wherein the second laser light source is a pulsed laser generating a probe laser pulse.

21. The measuring apparatus of claim 18, wherein the first and second laser light sources are identical.

22. The measuring apparatus of claim 18, further comprising a beam splitter and a delay-stage.

23. The measuring apparatus of claim 18, wherein the pump area and the probe area of the surface overlap.

24. The measuring apparatus of claim 18, wherein the detector is a position resolving detector or a detector array.

25. The measuring apparatus of claim 18, further comprising a device for adjusting a pulse rate of laser pulses.

26. The measuring apparatus of claim 18, further comprising a window for the laser beam in a polish head of a polishing apparatus.

27. A polishing apparatus comprising the measuring apparatus of claim 18.

* * * * *